US010350673B2

(12) United States Patent
Lee et al.

(10) Patent No.: US 10,350,673 B2
(45) Date of Patent: Jul. 16, 2019

(54) HOLLOW SALT CORE AND METHOD OF MANUFACTURING THE SAME

(71) Applicants: Hyundai Motor Company, Seoul (KR); Kia Motors Corporation, Seoul (KR)

(72) Inventors: Cheol-Ung Lee, Busan (KR); Ji-Yong Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 95 days.

(21) Appl. No.: 15/622,641

(22) Filed: Jun. 14, 2017

(65) Prior Publication Data

US 2018/0281052 A1 Oct. 4, 2018

(30) Foreign Application Priority Data

Mar. 30, 2017 (KR) ..... 10-2017-0040933

(51) Int. Cl.
*B22C 9/10* (2006.01)

(52) U.S. Cl.
CPC ..... *B22C 9/105* (2013.01)

(58) Field of Classification Search
CPC ..... B22C 9/10; B22C 9/105
USPC ..... 164/369, 522, 15, 23, 28
See application file for complete search history.

(56) References Cited

U.S. PATENT DOCUMENTS

2016/0158831 A1* 6/2016 Hartig ..... B22C 9/105 164/518
2016/0167116 A1* 6/2016 Hartig ..... B22C 9/105 164/24

FOREIGN PATENT DOCUMENTS

DE 10 2012 108 079 B3 * 11/2013 ..... B22C 9/105

* cited by examiner

*Primary Examiner* — Kevin P Kerns
(74) *Attorney, Agent, or Firm* — Morgan, Lewis & Bockius LLP

(57) ABSTRACT

A method of manufacturing a hollow salt core may include an injection operation, in which molten salt including an ingredient of a salt core is injected into a mold through pressurization; a primary maintenance operation, in which a pressure is maintained in the mold including the injected molten salt; a primary decompressing operation, in which a portion of the molten salt maintained with the pressure is collected in the mold through decompression of the mold; a secondary maintenance operation, in which a pressure is maintained in the mold including the residual molten salt after the primary decompressing operation; and a secondary decompressing operation, in which the pressure of the mold is decreased after the secondary maintenance operation.

7 Claims, 9 Drawing Sheets

HOLLOW SALT CORE AND METHOD OF MANUFACTURING THE SAME

CROSS-REFERENCE(S) TO RELATED APPLICATIONS

The present application claims priority to Korean Patent Application No. 10-2017-0040933, filed on Mar. 30, 2017, the entire contents of which is incorporated herein for all purposes by this reference.

BACKGROUND OF THE INVENTION

Field of the Invention

The present invention relates to a hollow salt core, and more particularly, to a hollow salt core manufactured by collecting molten salt inside a salt core by decreasing a maintaining time and decreasing pressure, and a method of manufacturing the same.

Description of Related Art

A manufacturing method widely used for an aluminum component applied to a vehicle is a high pressure casting method. A high pressure casting method has a processing time of about 10% of those of conventional gravity casting method and low pressure casting method, and has high productivity and a large effect in decreasing manufacturing cost.

However, when a complex flow path or an undercut shape is present in the aluminum component, it is impossible to implement the complex flow path or the undercut shape with the high pressure casting method, so that the aluminum component is manufactured by inserting a core into a mold. The core needs to have a mechanical strength high enough to endure the heat and pressure of a molten metal and maintain a shape thereof during the casting, and simultaneously needs to be easily broken or dissolved in another material so that the core is easily removed from a casting product after the casting.

Sand, thermosetting resin, or salt are generally used as a material of the core. However, the methods of using sand or thermosetting resin cause an environmental problem and have a problem in that the core has low strength or is not easily removed. Accordingly, a high strength salt core using salt, which does not cause an environmental problem and is capable of enduring the high pressure casting during the manufacturing of an aluminum component, as a material is used.

In a conventional method of manufacturing a salt core, the salt core is generally manufactured by a low pressure casting method. However, when the salt core is manufactured by the low pressure casting method, the core is deformed by a difference in a solidification speed between a thick portion and a thin portion. In addition, when the high pressure casting method is applied to the manufacturing of an aluminum component, it is not easy to mount the core due to the deformation of the core. Further, when salt is used as a material of the core, there is a problem that even though the salt is recycled after the collapse, 100% of the salt fails to be collected and residual salt remains.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method of manufacturing a hollow salt core, in which salt is used as a material of a high strength collapsible core, and the core is manufactured using a low pressure casting method. Moreover, a portion of an internal side of the salt core is collected by decreasing a pressure maintaining time and a pressure to manufacture the core with a hollow structure.

The present invention, in various aspects, has also been made in an effort to solve the problems in the prior art, and presents a hollow salt core, which is manufactured by the aforementioned manufacturing method, and of which the strength is maintained during a process of manufacturing an aluminum component, and a deformation rate and a shrinkage rate are decreased by utilizing a uniform thickness of the salt core.

A technical object to be achieved in an exemplary embodiment of the present invention is not limited to the aforementioned technical objects, and other not-mentioned technical objects will be obviously understood by those skilled in the art from the description below.

Various aspects of the present invention are directed to providing a method of manufacturing a hollow salt core, including: an injection operation in which molten salt, including an ingredient of a salt core, is injected into a mold through pressurization; a primary maintenance operation in which a pressure is maintained in the mold including the injected molten salt; a primary decompressing operation in which a portion of the molten salt maintained with the pressure is collected in the mold through decompression of the mold; a secondary maintenance operation in which a pressure is maintained in the mold including the residual molten salt after the primary decompressing operation; and a secondary decompressing operation in which the pressure of the mold is decreased after the secondary maintenance operation.

In various exemplary embodiments, a temperature of the molten salt may range from 650° C. to 750° C.

In various exemplary embodiments, a temperature of the mold may range from 300° C. to 400° C.

In various exemplary embodiments, the primary maintenance operation may be maintained for 20 seconds to 40 seconds.

In various exemplary embodiments, the secondary maintenance operation may be maintained for 5 seconds to 30 seconds.

In various exemplary embodiments, the method of manufacturing the hollow salt core may be low pressure casting.

Various aspects of the present invention are directed to providing a hollow salt core manufactured by the method of manufacturing the hollow salt core.

In various exemplary embodiments, a thickness of the hollow salt core may range from 4 mm to 10 mm.

In various exemplary embodiments, traverse rupture strength of the hollow salt core may range from 20 MPa to 32 MPa.

In various exemplary embodiments, a shrinkage rate of the hollow salt core may range from 0.56% to 0.60%.

According to the method of manufacturing the hollow salt core of the present invention, the shape of the salt core is formed in the hollow structure by use of the low pressure casting method, so that it is possible to secure economic feasibility according to a decrease in quantity of salt used and a decrease in processing time, and there is an effect in decreasing a deformation rate by utilizing a uniform thickness of the salt core.

Various aspects of the present invention are directed to providing an effect in maintaining a strength of the salt core and decreasing a shrinkage rate during the casting process of an aluminum component, and also provides an effect in preventing a hole from being generated in the salt core having the hollow structure by the maintaining and decompressing operations according to an exemplary embodiment of the present invention.

In the above respects, various aspects of the present invention provide a hollow salt core in which an internal shape of the salt core is manufactured in a hollow type including a minimum thickness configured to resist a high pressure of the high pressure casting method which manufactures an aluminum component. The present invention has the advantages of decreasing the quantity of salt used, decreasing a processing time, and a uniform thickness of the salt core, decreasing a deformation rate of the salt core, and a method of manufacturing the same.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
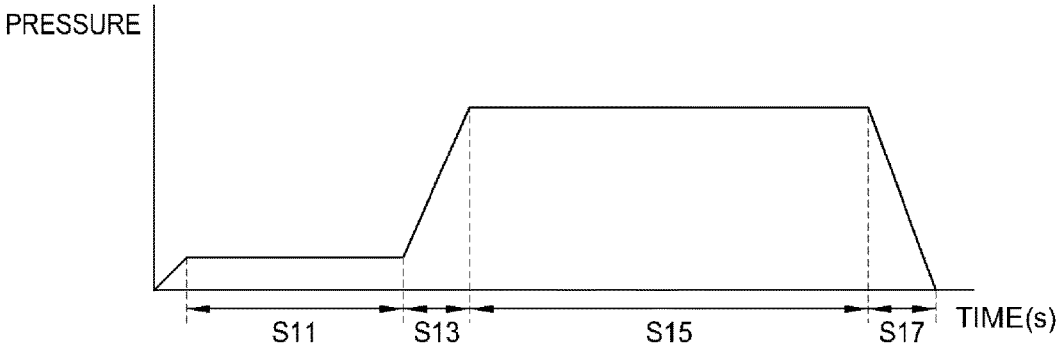
FIG. 1 (Prior art)
FIG. 1 is a diagram schematically illustrating a low pressure casting process of a salt core according to the prior art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In relation to a method of manufacturing a salt core, a salt core is manufactured by a low pressure casting method in the prior art, and in the present case, the core is deformed due to a difference in a solidification speed between a thick portion and a thin portion. In addition, when a high pressure casting method is applied to the manufacturing of an aluminum component, it is not easy to mount the core due to the deformation of the core. Further, there is a problem in that even though the salt is recycled after the collapse, 100% of the salt fails to be collected as residual salt remains.

The prior art having the problems mentioned above will be described in more detail. FIG. 1 is a diagram schematically illustrating a low pressure casting process of a salt core according to the prior art. As can be seen in FIG. 1, when a low pressure casting process is applied to a salt core according to the prior art, the process may include an injection operation S11, in which molten salt including a salt core ingredient of the related art is injected into a mold; a pressurizing operation S13, in which pressure is applied to the injected molten salt; a pressure maintaining operation S15, in which the pressure of the pressed molten salt is maintained in the mold; and a decompressing operation S17, in which the pressure is decreased after the pressure maintaining operation. In the present case, a maintaining time of the pressure maintaining operation is approximately 150 seconds to 200 seconds.

Figure 2:
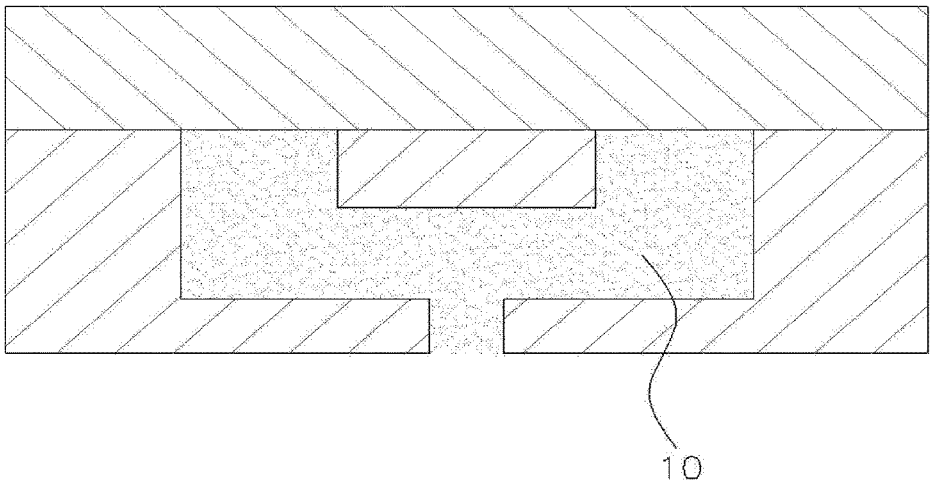
FIG. 2 (Prior art)
FIG. 2 is a diagram schematically illustrating a salt core according to the prior art filled in a mold and the mold.
Figure 3:
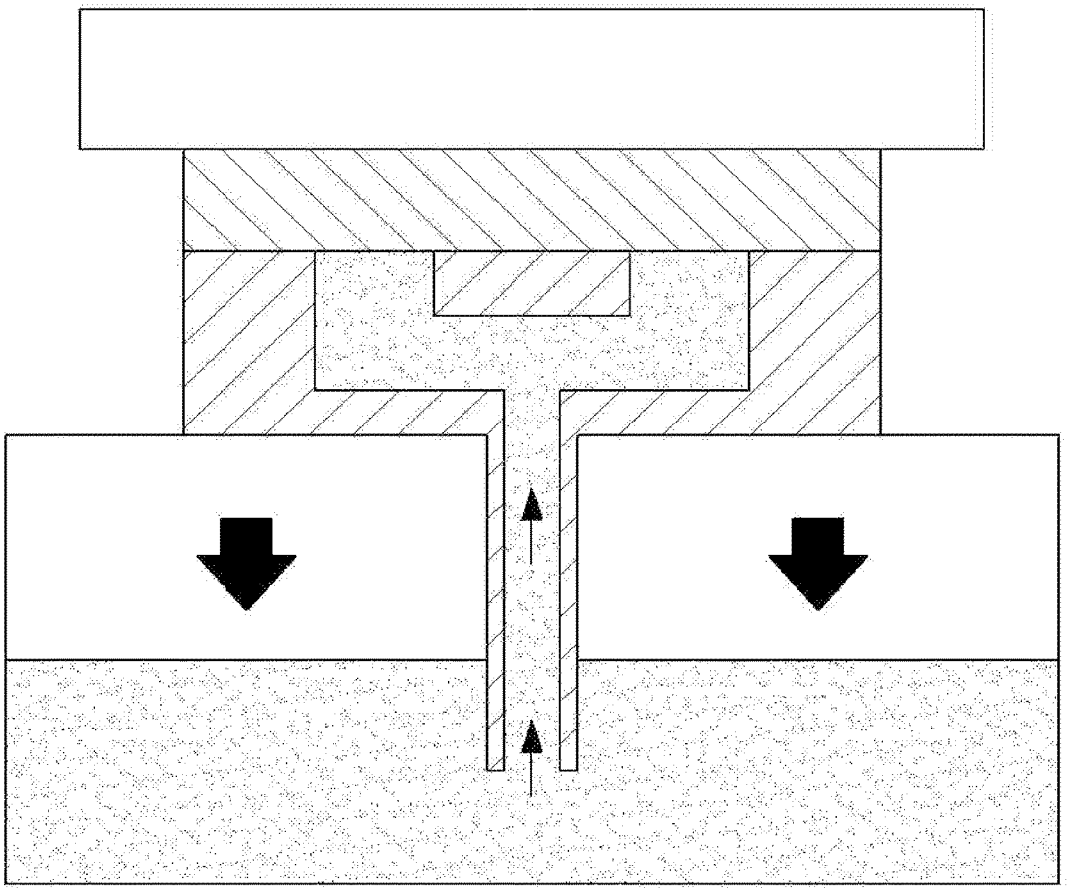
FIG. 3 (Prior art)
FIG. 3 is a diagram schematically illustrating the salt core according to the prior art, which is filled in the mold to receive pressure, and the mold.

FIG. 2 is a diagram schematically illustrating a salt core 10 filled in a mold according to the prior art and the mold, and FIG. 3 is a diagram schematically illustrating the salt core 10 according to the prior art, which is filled in the mold to receive pressure, and the mold.

As illustrated in FIG. 1 to FIG. 3, a method of manufacturing the salt core 10 according to the prior art requires a sufficient pressure maintaining time, and then is decompressed to complete the salt core. As described above, the salt core according to the prior art has a form, of which an internal side is filled, and may have a difference in a solidification speed between a thick portion and a thin portion and thus the core is deformed, making it difficult to mount the core when an aluminum component is manufactured. Further, a sufficient time is required for solidifying the core, so that a total processing time is increased.

In the present respect, various exemplary embodiments of the present invention are directed to providing a hollow salt core, in which a shape of the salt core is manufactured in a hollow type, including a minimum thickness configured to resist a high pressure of a high pressure casting method, which manufactures an aluminum component, so that the quantity of salt used is decreased, a processing time is decreased, and a thickness of the salt core is uniform, decreasing a deformation rate of the salt core, and a method of manufacturing the same. Further, various exemplary embodiments of the present invention are directed to providing a method of manufacturing a salt core including a decompressing operation and a pressure maintaining operation to prevent a hole from being generated in the salt core having a hollow structure.

Various aspects of the present invention are directed to providing a method in which a portion of an internal side of a salt core is collected by decreasing a pressure maintaining time to manufacture the salt core in a hollow type. In the present method, salt is used as a material of a high strength core, and the core is manufactured by a low pressure casting method.

Hereinafter, the present invention will be described in detail. Various embodiments of the present invention relates to a hollow salt core and a method of manufacturing the same.

Figure 4:
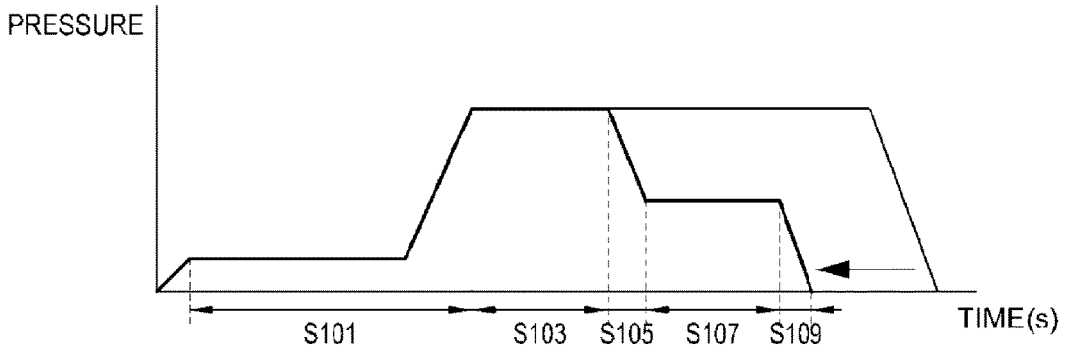
FIG. 4 is a diagram schematically illustrating a method of manufacturing a hollow salt core according to an exemplary embodiment of the present invention.

FIG. 4 is a diagram schematically illustrating a method of manufacturing a hollow salt core according to an exemplary embodiment of the present invention, and the method of manufacturing the hollow salt core of the present invention may be low pressure casting. Further, as can be seen in FIG. 4, the method of manufacturing the hollow salt core according to an exemplary embodiment of the present invention includes an injection operation S101, in which molten salt including an ingredient of a salt core is injected into a mold through pressurization, and a primary maintaining operation S103, in which the pressure of the mold including the injected molten salt is maintained, so that the molten salt is solidified. The primary maintaining operation S103 may be maintained for 20 seconds to 40 seconds. Further, the method of manufacturing the hollow salt core according to an exemplary embodiment of the present invention includes a primary decompressing operation S105, in which a portion of the molten salt, of which the pressure is maintained, is collected in the mold through decompression of the mold after the primary maintaining operation S103, and a secondary maintaining operation S107, in which the pressure of the mold is maintained so that the residual molten salt in the mold including the remaining molten salt may be solidified after the primary decompressing operation S105. The secondary maintaining operation S107 may be maintained for 5 seconds to 30 seconds. In addition, the method of manufacturing the hollow salt core according to an exemplary embodiment of the present invention includes a secondary decompressing operation S109, in which a shape of the completed salt core is removed from the mold since the pressure of the mold is decreased after the secondary maintaining operation S107.

The present method will be described in more detail with reference to FIG. 4. The injection operation S101, in which molten salt including an ingredient of the salt core, according to an exemplary embodiment of the present invention, is injected into a mold in the state where pressure is uniformly maintained through an injection port by pressurization, and then the molten salt is solidified after passing through the primary maintaining operation S103, in which the pressure is uniformly maintained. Then, a portion of the molten salt which is not solidified by the primary maintaining operation is collected through the injection port of the mold by the primary decompressing operation S105, in which the pressure is decreased. As described above, the hollow molten salt, according to an exemplary embodiment of the present invention, is manufactured by the primary decompressing operation. Further, the residual molten salt which is not collected in the mold after the primary decompressing operation is solidified by the secondary maintaining operation S107 in which the pressure is maintained, and the molten salt solidified by the secondary decompressing operation S109 is collected from the mold, so that the hollow salt core according to an exemplary embodiment of the present invention is manufactured.

In the present case, a temperature of the molten salt injected into the mold in an exemplary embodiment of the present invention may be 650° C. to 750° C., and a temperature of the mold may be 300° C. to 400° C., but the temperatures are not limited thereto.

According to an exemplary embodiment of the present invention, the pressure maintaining times in the primary maintaining operation and the secondary maintaining operation in the method of manufacturing the hollow salt core are 20 seconds to 40 seconds, and 5 seconds to 30 seconds respectively, and the time in the pressure maintaining operation in the prior art is 150 seconds to 200 seconds. As described above, the pressure maintaining time of the present invention is less than that of the prior art, so that a total pressing time is decreased.

In an exemplary embodiment of the present invention, the secondary maintaining operation and the secondary decompressing operation are applied, so that there is an effect in that a hole is not generated in the salt core having the hollow structure.

Figure 5:
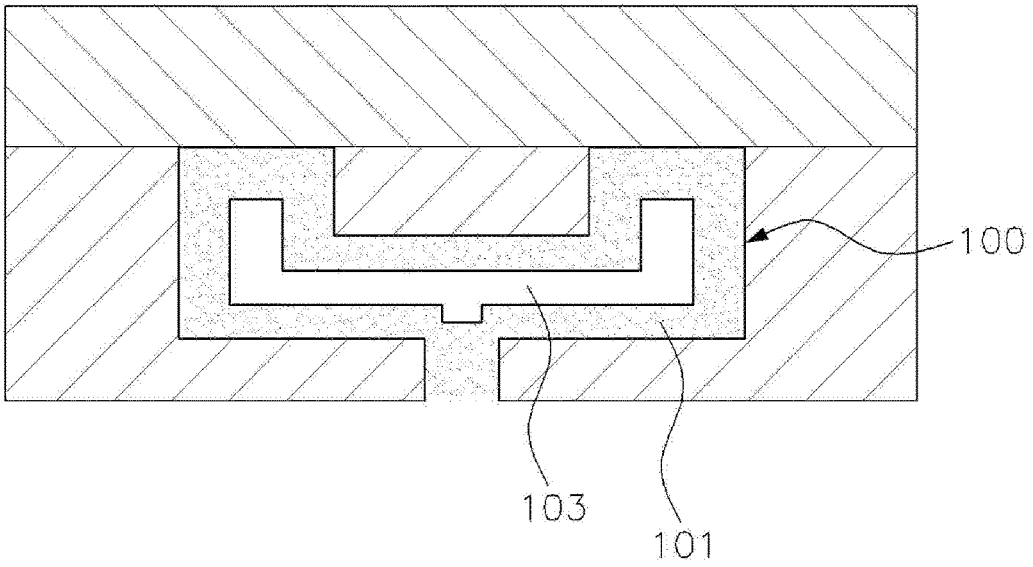
FIG. 5 is a diagram schematically illustrating a salt core filled in a mold and the mold according to an exemplary embodiment of the present invention.
Figure 6:
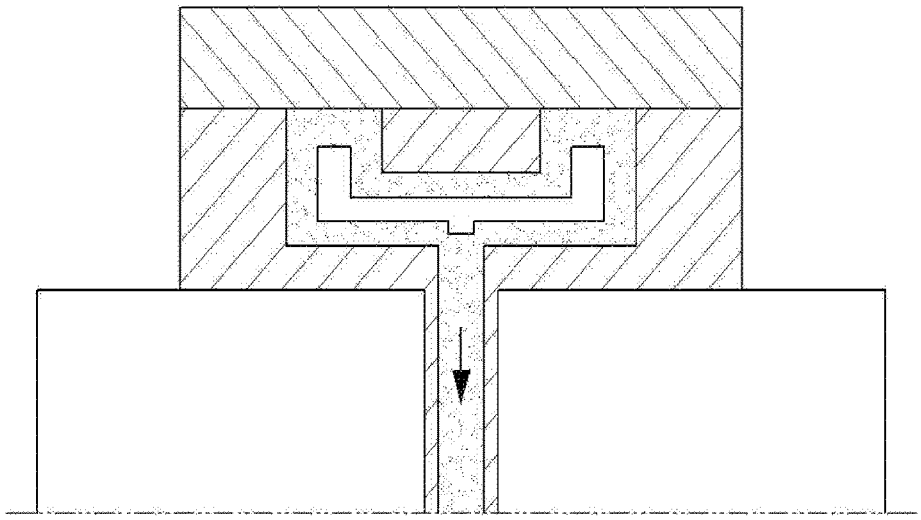
FIG. 6 is a diagram schematically illustrating a salt core formed with hollowness by a primary decompressing operation and a mold according to an exemplary embodiment of the present invention.
Figure 7:
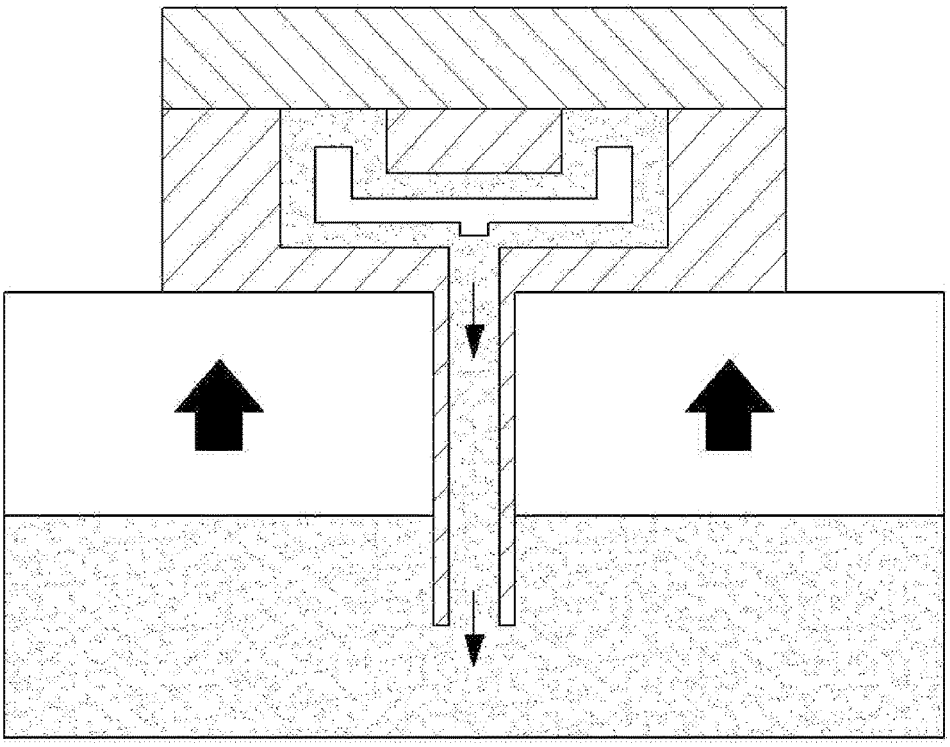
FIG. 7 is another diagram schematically illustrating a salt core formed with hollowness by a primary decompressing operation and a mold according to an exemplary embodiment of the present invention.

FIG. 5 is a diagram schematically illustrating a salt core 100, according to an exemplary embodiment of the present invention, filled in a mold and the mold, and FIG. 6 is a diagram schematically illustrating the salt core 100 formed with a hollow core by a primary decompressing operation and a mold according to an exemplary embodiment of the present invention. In addition to FIG. 6, FIG. 7 is another diagram schematically illustrating a salt core formed with hollowness by a primary decompressing operation and a mold according to an exemplary embodiment of the present invention. Arrows of FIG. 6 and FIG. 7 represent a decrease in pressure, and it can be seen that a portion of molten salt which is not solidified is collected by a decrease in pressure so that the hollow salt core is formed.

It can be seen from FIG. 5 that the salt core 100 according to an exemplary embodiment of the present invention has a shape of a hollow core 103, and in the present case, a thickness of the skin 101 is 4 mm to 10 mm. The thickness of the skin 101 of the salt core of FIG. 5 refers to a thickness of the hollow salt core formed from the residual molten salt, which is solidified after the non-solidified molten salt inside the salt core is collected in a process of the method of manufacturing the salt core according to an exemplary embodiment of the present invention.

It can be seen from FIG. 6 and FIG. 7 that the pressure is decreased by the primary decompressing operation according to an exemplary embodiment of the present invention, and thus a portion of the non-solidified molten salt of the salt core is discharged, so that the hollow salt core is manufactured.

Accordingly, the present invention may collect the non-solidified molten salt inside the salt core through the primary decompressing operation, and may manufacture the hollow salt core having the skin with a thickness of 4 mm to 10 mm.

The salt core is manufactured in a hollow type including a minimum thickness configured to resist a high pressure of the high pressure casting method of manufacturing an aluminum component, thereby decreasing the quantity of salt used.

Figure 11:
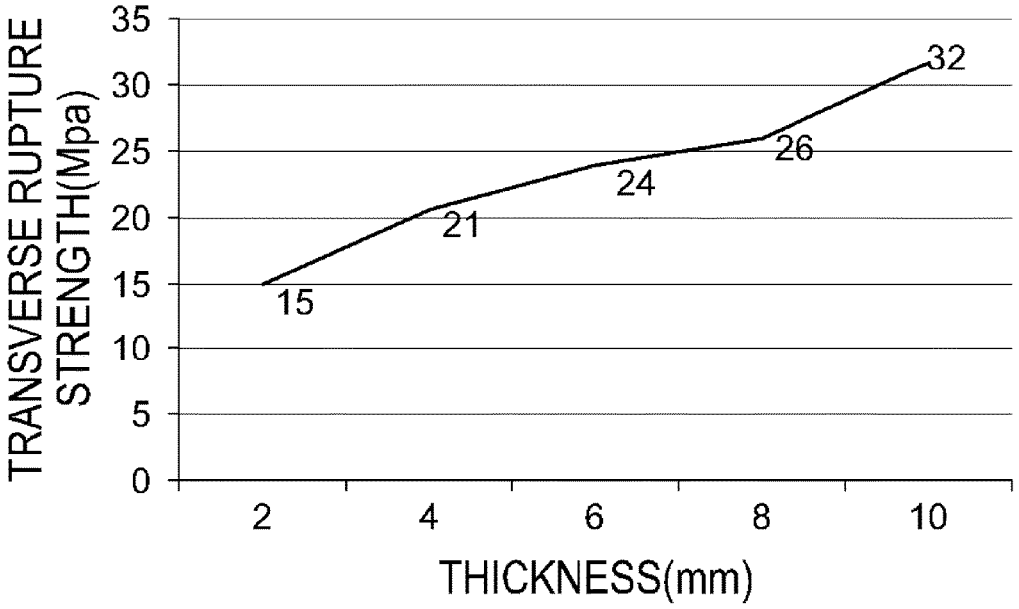
FIG. 11 is a graph of transverse rupture strength according to a thickness of the hollow salt core of the present invention.

FIG. 11 is a graph of transverse rupture strength according to a thickness of the hollow salt core of the present invention. It can be seen from FIG. 11 that when a thickness of the salt core is increased, transverse rupture strength is increased. More particularly, it can be seen from FIG. 11 that transverse rupture strength of the salt core with a thickness of 2 mm is about 15 MPa, transverse rupture strength of the salt core with a thickness of 4 mm is about 21 MPa, transverse rupture strength of the salt core with a thickness of 6 mm is about 24 MPa, transverse rupture strength of the salt core with a thickness of 8 mm is about 26 MPa, and transverse rupture strength of the salt core with a thickness of 10 mm is about 32 MPa.

According to an exemplary embodiment of the present invention, minimum transverse rupture strength, in which the core is broken during an injection of the high pressure casting method of manufacturing an aluminum component needs to be 20 MPa or more. As can be seen from FIG. 11, which represents a result of a transverse rupture strength evaluation according to a thickness, the salt core correlating to a transverse rupture strength of 20 MPa or more has a thickness of 4 mm or more.

Accordingly, a thickness of the hollow salt core of the present invention is 4 mm or more, and transverse rupture strength of the hollow salt core is 20 MPa or more, and when a thickness of the hollow salt core exceeds 10 mm, it is not appropriate to apply the hollow salt core to a component, so that a thickness of the hollow salt core may be 4 mm to 10 mm, and transverse rupture strength of the hollow salt core may be 20 MPa to 32 MPa.

Figure 12:
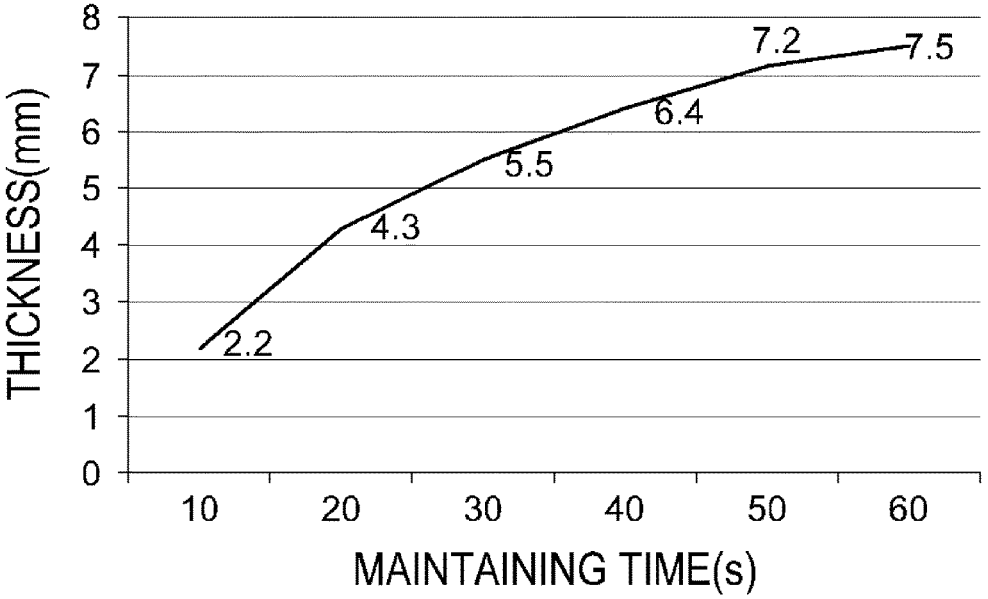
FIG. 12 is a graph of a thickness according to a maintaining time of the hollow salt core of the present invention.

In addition to FIG. 11, FIG. 12 is a graph of a thickness according to a maintaining time of the hollow salt core of the present invention. It can be seen from FIG. 12 that when a pressure maintaining time of the salt core is increased, a thickness of the salt core is increased.

More particularly, it can be seen from FIG. 12 that a thickness of the salt core is about 2.2 mm when a pressure maintaining time is 10 seconds, a thickness of the salt core is about 4.3 mm when a pressure maintaining time is 20 seconds, a thickness of the salt core is about 5.5 mm when a pressure maintaining time is 30 seconds, a thickness of the salt core is about 6.4 mm when a pressure maintaining time is 40 seconds, a thickness of the salt core is about 7.2 mm when a pressure maintaining time is 50 seconds, and a thickness of the salt core is about 7.5 mm when a pressure maintaining time is 60 seconds.

Accordingly, in the hollow salt core according to an exemplary embodiment of the present invention, minimum transverse rupture strength needs to be 20 MPa or more, and a thickness of the salt core needs to be 4 mm or more so that, as can be seen from FIG. 12, a pressure maintaining time for manufacturing the hollow salt core with a thickness of 4 mm or more may be a minimum of 20 seconds, as described above.

That is, the thickness is different according to a temperature of the molten salt, a temperature of the mold, and a shape of the core, but it can be seen that to prevent the core from being damaged during the high pressure casting, the hollow salt core needs to maintain a thickness of a minimum of 4 mm or more. In the present respect, according to an exemplary embodiment of the present invention, it can be seen from FIG. 12 that the hollow salt core has a thickness of 4 mm or more when a temperature of the molten salt is 650° C. to 750° C. and a temperature of the mold is 300° C. to 400° C., and a time taken for forming the thickness is a minimum of 20 seconds or more.

A decrease of the quantity of deformation of the salt core according to an exemplary embodiment of the present invention is about 5%, compared to that of the prior art, and there is an effect in securing stability of a numerical value of a product due to improvements of solidification and shrinkage characteristics.

Figure 8:
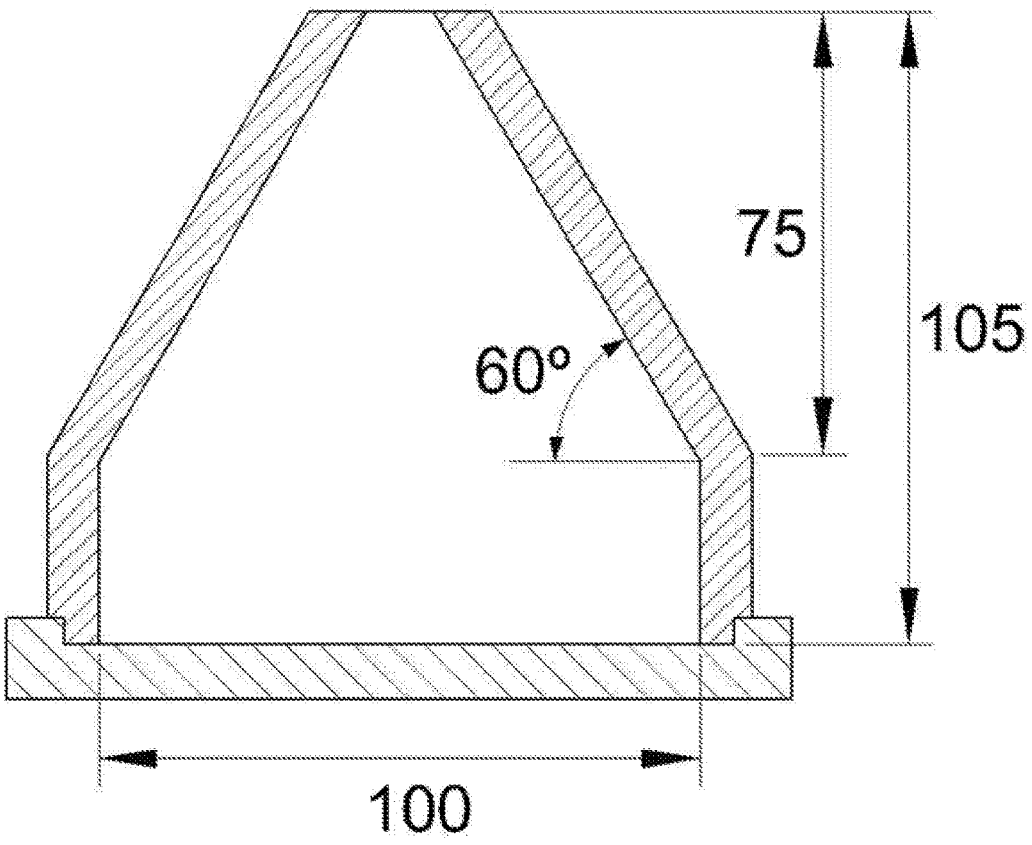
FIG. 8 is a diagram of a mold for evaluating a shrinkage rate.
Figure 9:
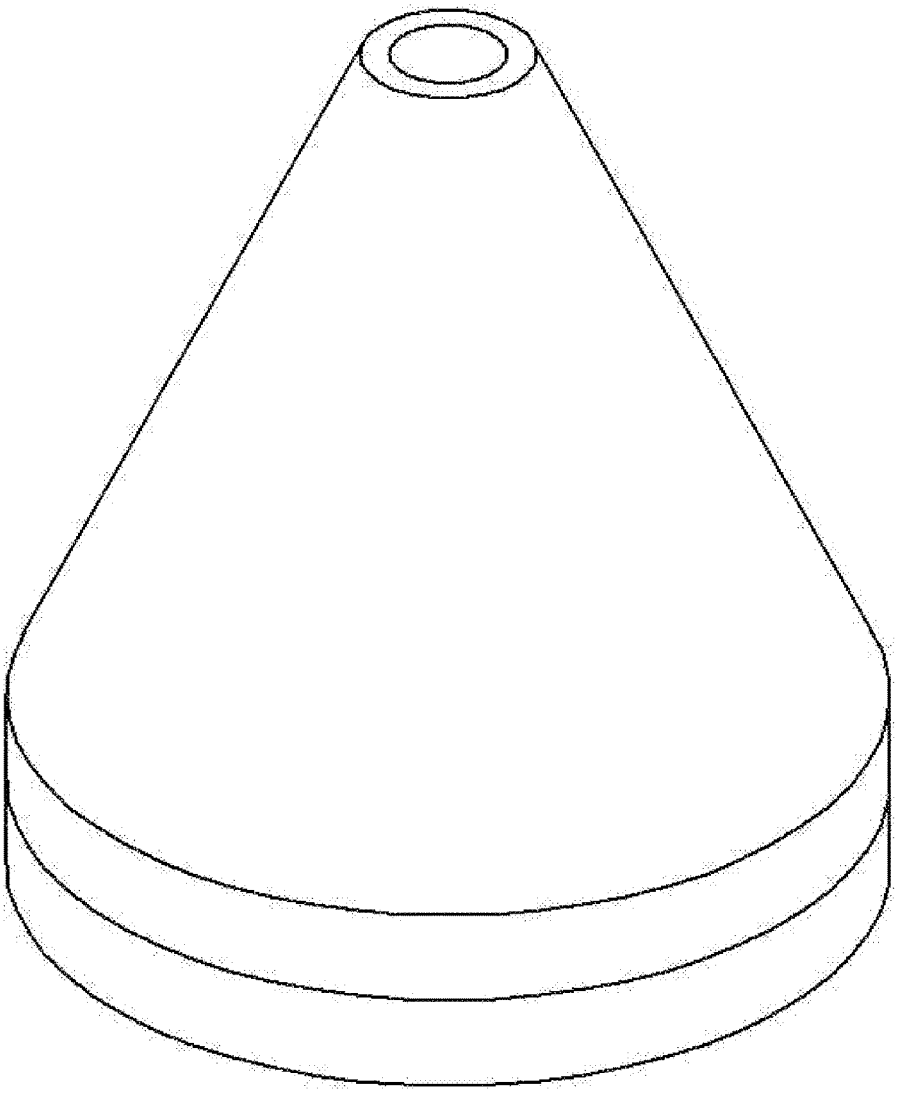
FIG. 9 is a diagram illustrating a state where a salt core is filled in a mold for evaluating a shrinkage rate.
Figure 10:
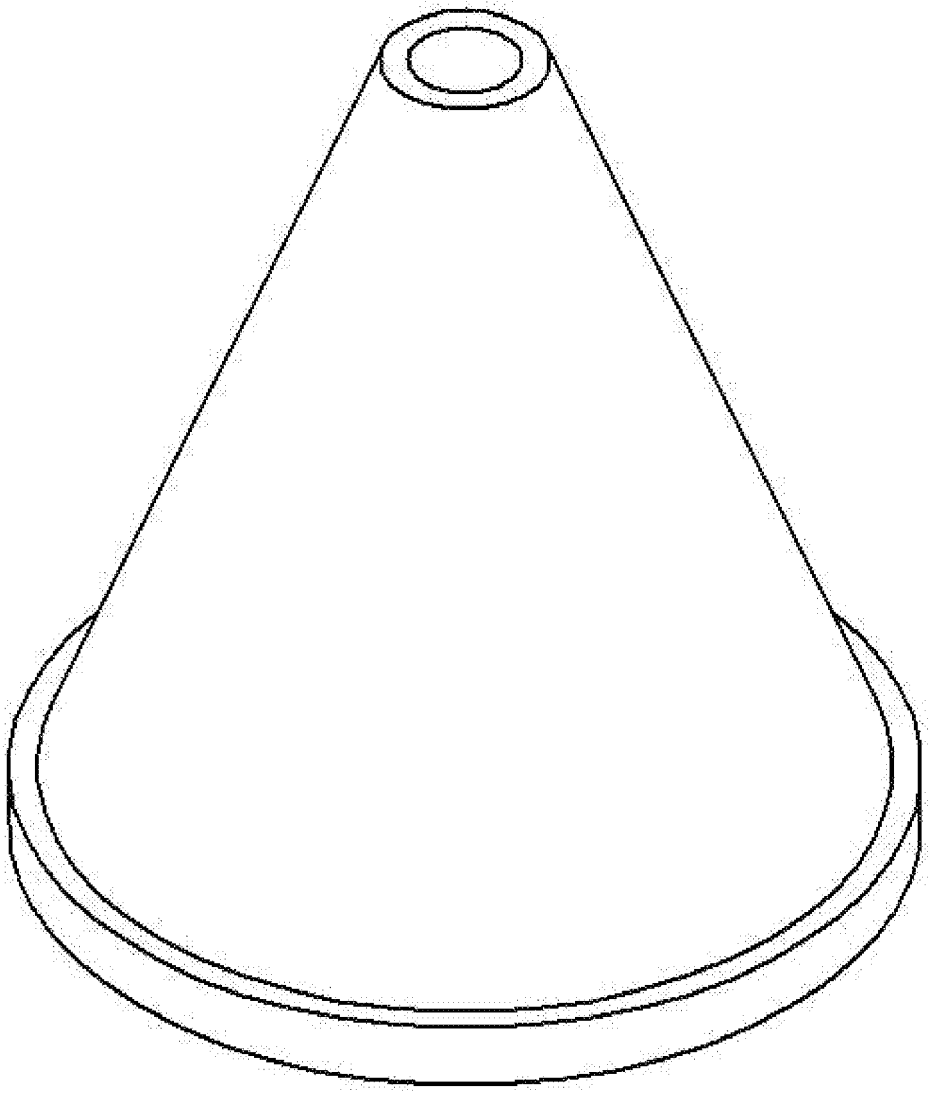
FIG. 10 is a diagram of a shrinkage rate evaluation specimen.
Figure 13:
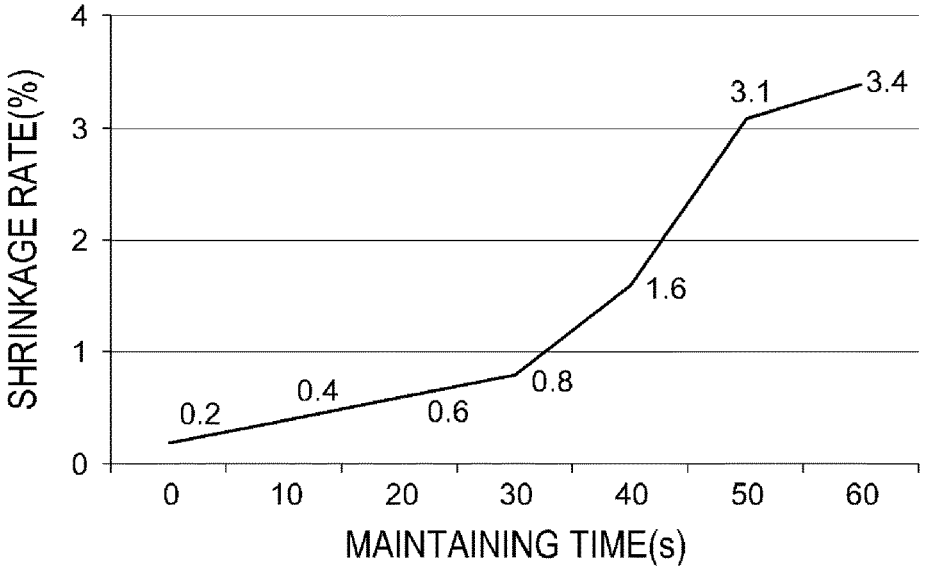
FIG. 13 is a graph of a shrinkage rate between a mold and a specimen according to a maintaining time after injecting molten salt.

In the meantime, to evaluate a shrinkage rate of the salt core according to an exemplary embodiment of the present invention, a shrinkage rate between the mold and a specimen for the evaluation was measured by injecting the molten salt into the mold and having a maintaining time of 0 second to 60 seconds. FIG. 8 is a diagram of a mold for evaluating a shrinkage rate, FIG. 9 is a diagram illustrating a state where the salt core is filled in the mold for evaluating a shrinkage rate, and FIG. 10 is a diagram of a specimen for a shrinkage rate evaluation. FIG. 13 is a graph of a shrinkage rate between the mold and the specimen according to a maintaining time after injecting the molten salt. That is, FIG. 13 is a graph after an evaluation of a shrinkage rate of the salt core by use of the mold represented in FIG. 8 and FIG. 9, and FIG. 10 represents a form of a specimen of the completed salt core.

As can be seen from FIG. 8, the mold used in the evaluation has a diameter of about 100 mm and has a total height of about 105 mm, and a height of the conical mold is about 75 mm.

It can be seen from FIG. 13 that a shrinkage rate is increased according to the maintaining time as a result of the evaluation of the shrinkage rate, and when the pressure maintaining time exceeds 40 seconds, a shrinkage rate exceeds 1%. More particularly, it can be seen from FIG. 13 that when the maintaining time is 10 seconds, a shrinkage rate is about 0.4%, when the maintaining time is 20 seconds, a shrinkage rate is about 0.6%, when the maintaining time is 30 seconds, a shrinkage rate is about 0.8%, when the maintaining time is 40 seconds, a shrinkage rate is about 1.6%, when the maintaining time is 50 seconds, a shrinkage rate is about 3.1%, and when the maintaining time is 60 seconds, a shrinkage rate is about 3.4%. Accordingly, through the evaluation of the shrinkage rate, it can be seen that when the maintaining time is long, a shrinkage rate of the hollow salt core according to an exemplary embodiment of the present invention is increased.

As described above, as can be seen from FIG. 13, when the pressure maintaining time exceeds 40 seconds, the shrinkage rate exceeds 1%, so that the pressure maintaining time of the primary maintaining operation according to an exemplary embodiment of the present invention may be 40 seconds or less.

As described above with reference to FIG. 12, the pressure maintaining time for forming the salt core having the thickness of 4 mm or more is a minimum of 20 seconds or more, so that the pressure maintaining time of the primary maintaining operation according to an exemplary embodiment of the present invention may be 20 seconds to 40 seconds, but is not limited thereto.

Figure 14:
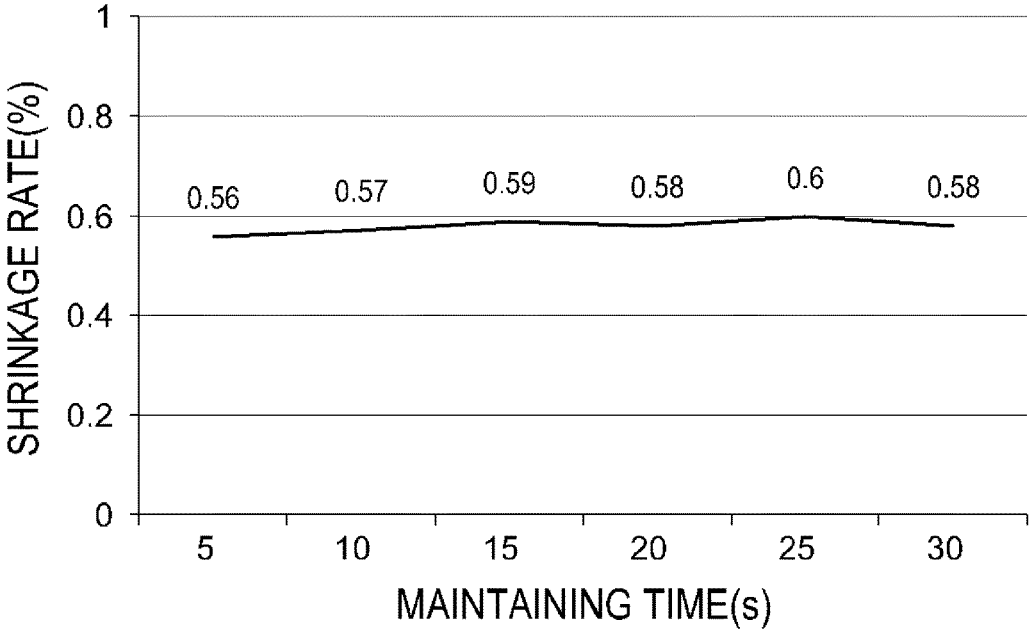
FIG. 14 is a graph of a shrinkage rate according to a maintaining time after molten salt is injected into a mold, 20 seconds are maintained, and then the molten salt is removed.

FIG. 14 is a graph of a shrinkage rate according to a maintaining time after molten salt is injected into a mold, 20 seconds are maintained, and then the molten salt is removed. Similar to FIG. 13, in FIG. 14, an evaluation is performed by use of the mold of FIG. 8 and FIG. 9, and a shrinkage rate is measured according to a maintaining time by injecting molten salt into the mold, maintaining for 20 seconds, and then removing the molten salt. In the present case, as illustrated in FIG. 12, 20 seconds are maintained, so that a thickness of the salt core is about 4.3 mm, and as a result of the evaluation of a shrinkage rate according to a maintaining time, a shrinkage time according to the maintaining time of 5 seconds to 30 seconds is within 0.56% to 0.60%, so that a change in a shrinkage rate according to a maintaining time may be considered slight.

More particularly, referring to FIG. 14, when a maintaining time is 5 seconds, a shrinkage rate is about 0.56%, when a maintaining time is 10 seconds, a shrinkage rate is about 0.57%, when a maintaining time is 15 seconds, a shrinkage rate is about 0.59%, when a maintaining time is 20 seconds, a shrinkage rate is about 0.58%, when a maintaining time is 25 seconds, a shrinkage rate is about 0.60%, and when a maintaining time is 30 seconds, a shrinkage rate is about 0.58%.

Accordingly, the pressure maintaining time of the secondary maintaining operation according to an exemplary embodiment of the present invention may be 5 seconds to 30 seconds, but is not limited thereto.

As described above, a solidifying time of the thick portion is similar to a solidifying time of the thin portion, so that the present invention are directed to providing the hollow salt core having the uniform thickness, and provides an effect in decreasing the internal stress of the salt core. Further, the present invention adopts the maintaining and decompressing operations, providing an effect in preventing a hole from being formed in the salt core having the hollow structure.

In the salt core according to an exemplary embodiment of the present invention, the molten salt inside the salt core is removed through the decompression, so that the hollow salt core is manufactured. Accordingly, weight of filled salt is decreased, so that the present invention also has an effect in decreasing manufacturing cost by about 5% to 10%.

That is, according to the method of manufacturing the hollow salt core of the present invention, the shape of the salt core is formed in the hollow structure by use of the low pressure casting method, so that it is possible to secure economic feasibility according to a decrease in quantity of salt used and a decrease in processing time, and there is an effect in decreasing a deformation rate by utilizing a uniform thickness of the salt core. Further, various aspects of the present invention are directed to providing an effect in maintaining strength of the salt core and decreasing a shrinkage rate during the casting process of an aluminum component. In addition, the present invention adopts the secondary maintaining operation and the secondary decompressing operation, so that there is an advantage in that a hole is not generated in the salt core having the hollow structure.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with referent to the positions of such features as displayed in the figures.

The foregoing descriptions of specific exemplary embodiments of the present invention have been presented for purposes of illustration and description. They are not intended to be exhaustive to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the claims appended hereto and their equivalents.

What is claimed is:

1. A method of manufacturing a hollow salt core, comprising:

an injection operation, in which molten salt including an ingredient of a salt core is injected into a mold through pressurization;

a primary maintenance operation, in which a pressure is maintained in the mold including the injected molten salt;

a primary decompressing operation, in which a portion of the molten salt maintained with the pressure is collected in the mold through decompression of the mold;

a secondary maintenance operation, in which a pressure is maintained in the mold including a residual molten salt after the primary decompressing operation; and a secondary decompressing operation, in which the pressure of the mold is decreased after the secondary maintenance operation.

2. The method of claim 1, wherein a temperature of the molten salt is 650° C. to 750° C.

3. The method of claim 1, wherein a temperature of the mold is 300° C. to 400° C.

4. The method of claim 1, wherein the primary maintenance operation is maintained for 20 seconds to 40 seconds.

5. The method of claim 1, wherein the secondary maintenance operation is maintained for 5 seconds to 30 seconds.

6. The method of claim 1, wherein the method of manufacturing the hollow salt core is low pressure casting.

7. A hollow salt core comprising a thickness of 4 mm to 10 mm, wherein the hollow salt core has a transverse rupture strength of 20 MPa to 32 MPa, and the hollow salt core has a shrinkage rate between 0.56% to 0.60%.

* * * * *